US007913393B2

(12) United States Patent
Royle et al.

(10) Patent No.: US 7,913,393 B2
(45) Date of Patent: Mar. 29, 2011

(54) SAFETY RAZOR WITH MULTI-PIVOT BLADE UNIT

(75) Inventors: Terence Gordon Royle, Basingstoke (GB); Edward Neill Forsdike, Reading (GB)

(73) Assignee: The Gillette Company, Boston, MA (US)

( * ) Notice: Subject to any disclaimer, the term of this patent is extended or adjusted under 35 U.S.C. 154(b) by 336 days.

(21) Appl. No.: 12/246,847

(22) Filed: Oct. 7, 2008

(65) Prior Publication Data

US 2010/0083505 A1 Apr. 8, 2010

(51) Int. Cl.
*B26B 21/00* (2006.01)

(52) U.S. Cl. ..... 30/50; 30/74; 30/77; 30/84; 30/527; 83/698.21

(58) Field of Classification Search ..... 30/51, 57, 30/74, 58, 59, 60, 60.5, 61, 40, 74.1, 77, 30/78, 84, 526, 527, 529, 531, 532; 83/698.11, 83/698.21
See application file for complete search history.

(56) References Cited

U.S. PATENT DOCUMENTS

| | | | |
|---|---|---|---|
| 2,643,579 | A | 6/1953 | Jacoby |
| 2,885,778 | A | 5/1959 | Randol |
| 2,967,354 | A | 1/1961 | Ahlborn |
| 3,740,841 | A | 6/1973 | Risher |
| 3,872,587 | A | 3/1975 | Wellinger |
| 4,245,388 | A | 1/1981 | Dawidowicz et al. |
| 4,284,968 | A | 8/1981 | Denoyelle et al. |
| 4,471,331 | A | 9/1984 | Wyatt |
| 4,496,921 | A | 1/1985 | Carrera |
| 4,779,332 | A | 10/1988 | Butka |
| 4,791,724 | A | 12/1988 | Dumas |
| 5,029,391 | A | 7/1991 | Althaus et al. |
| 5,526,568 | A | 6/1996 | Copelan |
| 5,535,518 | A | 7/1996 | Althaus |
| 5,848,475 | A | 12/1998 | Hill et al. |
| 5,868,055 | A | 2/1999 | Suter |
| 5,953,825 | A | 9/1999 | Christman et al. |
| 6,035,535 | A | 3/2000 | Dischler |
| 6,397,473 | B1 | 6/2002 | Clark |
| 6,421,918 | B1 | 7/2002 | Dato et al. |
| 7,200,942 | B2 | 4/2007 | Richard |
| 2001/0006069 | A1 | 7/2001 | Treskov et al. |
| 2003/0209829 | A1 | 11/2003 | Brown et al. |
| 2004/0098862 | A1 | 5/2004 | Orloff |
| 2004/0177519 | A1 | 9/2004 | Tomassetti et al. |
| 2005/0060898 | A1 | 3/2005 | Tomassetti et al. |
| 2007/0017099 | A1 | 1/2007 | Blackburn |

FOREIGN PATENT DOCUMENTS

| | | | |
|---|---|---|---|
| BR | PI 9905745-0 | A | 9/2000 |
| EP | 1 136 197 | B1 | 4/2003 |
| EP | 0 885 697 | B1 | 10/2003 |
| FR | 2 660 589 | | 10/1991 |
| FR | 2 663 255 | | 12/1991 |

(Continued)

*Primary Examiner* — Phong H Nguyen
(74) *Attorney, Agent, or Firm* — John M. Lipchitz; Kevin C. Johnson; Steven W. Miller

(57) ABSTRACT

A safety razor blade unit mounted for pivotal movement relative to a razor handle about a pivot axis substantially perpendicular to a blade mounted in the blade unit. The blade unit is biased to a rest position by a magnetic return force generated by a set of magnetic elements. The set of magnetic elements are so disposed that the return force increases as the pivotal displacement of the blade unit from the rest position increases.

14 Claims, 4 Drawing Sheets

FOREIGN PATENT DOCUMENTS

| | | | |
|---|---|---|---|
| GB | 512440 | | 9/1939 |
| GB | 2 116 470 | A | 9/1983 |
| JP | 1996323065 | A | 12/1996 |
| JP | 2001340671 | A | 12/2001 |
| JP | 2004033295 | A | 2/2004 |
| JP | 2005000303 | A | 1/2005 |
| JP | 2006-314720 | | 11/2006 |
| RU | 2 093 349 | C1 | 10/1997 |
| WO | WO 93/10947 | | 6/1993 |
| WO | WO 93/20983 | | 10/1993 |
| WO | WO 97/19790 | | 6/1997 |
| WO | WO 97/37819 | | 10/1997 |
| WO | WO 01/39937 | | 6/2001 |
| WO | WO 2004/076136 | | 9/2004 |
| WO | WO 2005/000542 | | 1/2005 |
| WO | WO 2005/049289 | | 6/2005 |

SAFETY RAZOR WITH MULTI-PIVOT BLADE UNIT

FIELD OF THE INVENTION

This invention relates to safety razors and it is particularly concerned with safety razors in which a safety razor blade unit including at least one blade with a sharp cutting edge is mounted on a razor handle to be movable pivotally relative to the handle under forces exerted on the blade unit in the course of shaving. A blade unit may have a plurality of blades, for example two, three, four or more blades, with straight parallel cutting edges disposed for contact with the skin between guard and cap surfaces also provided on the blade unit. The guard may include a strip of elastomeric material with a surface configuration, for example upstanding projections such as in the shape of fins, to produce a desired interaction with the skin as the blade unit is moved across the skin in the performance of a shaving stroke. The cap surface may include a strip of material containing a shaving enhancement product, such as a lubricant, which can gradually leach out of the strip material for application to the skin during shaving. The safety razor blade unit may be mounted detachably on the razor handle to allow the blade unit to be replaced by a fresh blade unit when the blade sharpness has diminished to an unsatisfactory level. Alternatively, the blade unit can be connected permanently to the handle with the intention that the entire razor should be discarded when the blade or blades have become dulled. Detachable and replaceable blade units are commonly referred to as shaving cartridges.

BACKGROUND OF THE INVENTION

The present invention relates to safety razors with blades units arranged to be capable of pivoting movement about an axis substantially perpendicular to the cutting edges of the blade(s). The pivoting motion allows the blade unit to more easily follow the skin contours so that the exact angle at which the handle is held relative to the skin is less critical to achieving a good shaving performance and efficiency. Razors with pivotal blade units have been successfully marketed for many years. The traditional pivot axis, which usually extends parallel to the cutting edges of the blades, can be defined by a pivot structure by means of which the handle is connected to the blade unit. Alternatively the blade unit may include an attachment member to which a frame or housing incorporating the blade or blades and other skin contacting parts is pivotally connected. A blade unit of this form described in WO 97/37819, the content of which is incorporated herein by reference, has an attachment member in the general form of a yoke with a hub for engagement with the upper end of the handle and a pair of oppositely directed arms provided with pivot journals at their ends for engagement in sockets provided at the ends of the frame. Retention clips are applied around the respective ends of the frame to maintain the pivot journals within the sockets.

A razor having a blade unit mounted for pivotal movement about a single axis substantially parallel to the blade edges has been proposed. The blade unit is biased to a rest position by a magnetic return force generated by magnets. The pivotal movement about the single axis substantially parallel to the blade edges provides some degree of conformance with the skin allowing the blade unit to more easily follow the skin contours during shaving. However, the blade unit often disengages from the skin during shaving as it has limited ability to pivot about a single axis.

The present invention addresses this drawback by employing a magnetic return force about a pivot axis that is substantially perpendicular to the blade edges allowing for improved conformance of the blade unit with the users skin during shaving.

SUMMARY OF THE INVENTION

Provided in accordance with the present invention is a safety razor comprising a handle and a blade unit with a guard, a cap and at least one blade. The blade unit is mounted to the handle for movement relative thereto about a pivot axis substantially perpendicular to the at least one blade for following the skin contours during shaving. The blade unit has a rest position towards which the blade unit is biased by a return force when pivoted about the pivot axis away from the rest position. The return force comprises a magnetic force generated by a set of magnetic elements that are moved relative to each other in response to pivotal movement of the blade unit about the pivot axis substantially perpendicular to the at least one blade. The return force increases in magnitude as the blade unit pivots away from the rest position.

Also provided is a safety razor comprising a handle and a blade unit with a guard, a cap and at least one blade. The blade unit is mounted to the handle for movement relative thereto about a first pivot axis and a second pivot axis for following the skin contours during shaving. The blade unit has a first rest position and a second rest position towards which the blade unit is biased by a first return force and a second return force. The first return force occurs when the blade unit is pivoted about the first pivot axis away from the first rest position. The first return force comprises a magnetic force generated by a first set of magnetic elements that are moved relative to each other in response to pivotal movement of the blade unit about the first pivot axis substantially parallel to the at least one blade. The first return force increases in magnitude as the blade unit pivots away from the first rest position. The second return force occurs when the blade unit is pivoted about the second pivot axis away from the second rest position. The second return force comprises a magnetic force generated by a second set of magnetic elements that are moved relative to each other in response to pivotal movement of the blade unit about the second pivot axis which is distinct from said first pivot axis. The second return force increases in magnitude as the blade unit pivots away from the second rest position.

By use of a magnetically generated restoring force a very smooth and consistently reproducible pivotal movement can be ensured. The magnetic force can be conveniently generated by magnetic elements that are moved relative to each other in response to pivotal movement of the blade unit relative to the handle, and interact repulsively to urge the blade unit to the respective rest positions.

Preferably the first set of magnetic elements are arranged to generate a repulsive magnetic return force for urging the blade unit to the first rest position. Similarly, the second set of magnetic elements are arranged to generate a repulsive magnetic return force for urging the blade unit to the second rest position.

The first set of magnetic elements may comprise a first magnetic element and a second magnetic element and the first magnetic element is mounted to the blade unit adjacent the cap. However, the first set of magnetic elements may comprise more than two magnetic elements, e.g., two sets of opposed pairs.

Conveniently, the blade unit is pivotally carried by a pair of opposed arms extending from a hub, and the second magnetic element is positioned at the hub.

The first pivot axis is preferably positioned in front of the at least one blade. The first pivot axis may be located below a plane tangential to the guard and cap.

Advantageously the magnetic elements which produce the first and second return forces are so arranged that as the angle of pivoting about the first and second pivot axes from the first and second rest position increases, the spring rate characteristic of the magnetic return force increases smoothly. A further advantage of the invention is that the strength of the return forces can easily be modified by using magnetic elements of different magnetic strength.

The first pivot axis is preferably positioned to be substantially perpendicular to the second pivot axis.

Although the magnetic elements can conveniently be permanent magnets, at least one of the magnetic elements can comprise an electromagnetic element, in which case a control device can be provided for adjusting the electric magnetizing current delivered to the electromagnetic element. A sensor may, for example, be provided to sense the pivotal displacement of the blade unit from the rest position and the control device can be responsive to an output from the sensor.

The second set of magnetic elements preferably comprises a third magnetic element, a fourth magnetic element and a fifth magnetic element. The second set of magnetic elements may comprise a sixth magnetic element.

The third magnetic element may be mounted to the handle and the fourth and fifth magnets may be mounted to the blade unit. Alternatively, the third magnetic element may be mounted to the blade unit and the fourth and fifth magnets may be mounted to the handle.

BRIEF DESCRIPTION OF THE DRAWINGS

While the specification concludes with claims particularly pointing out and distinctly claiming the subject matter which is regarded as forming the present invention, it is believed that the invention will be better understood from the following description taken in conjunction with the accompanying drawings.

DETAILED DESCRIPTION OF THE INVENTION

Figure 1:
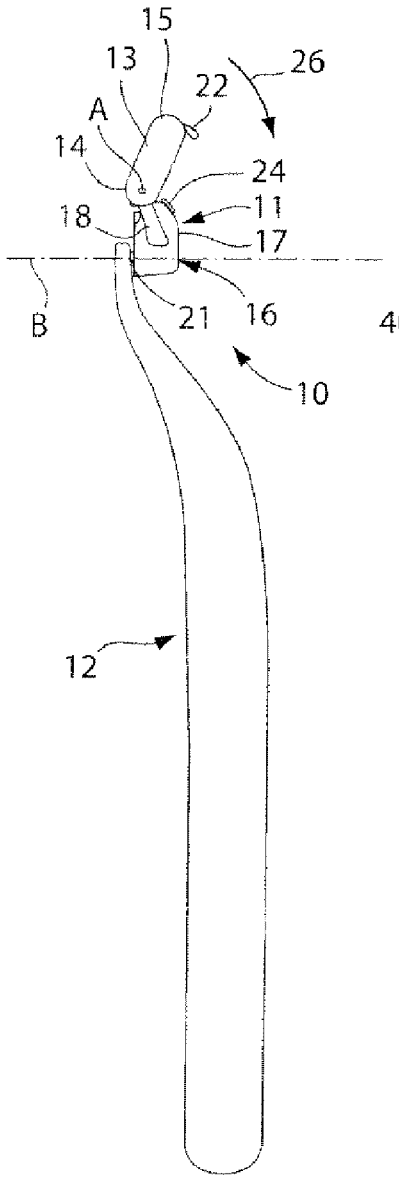
FIG. 1 shows in side elevation a safety razor in accordance with the present invention.
Figure 2:
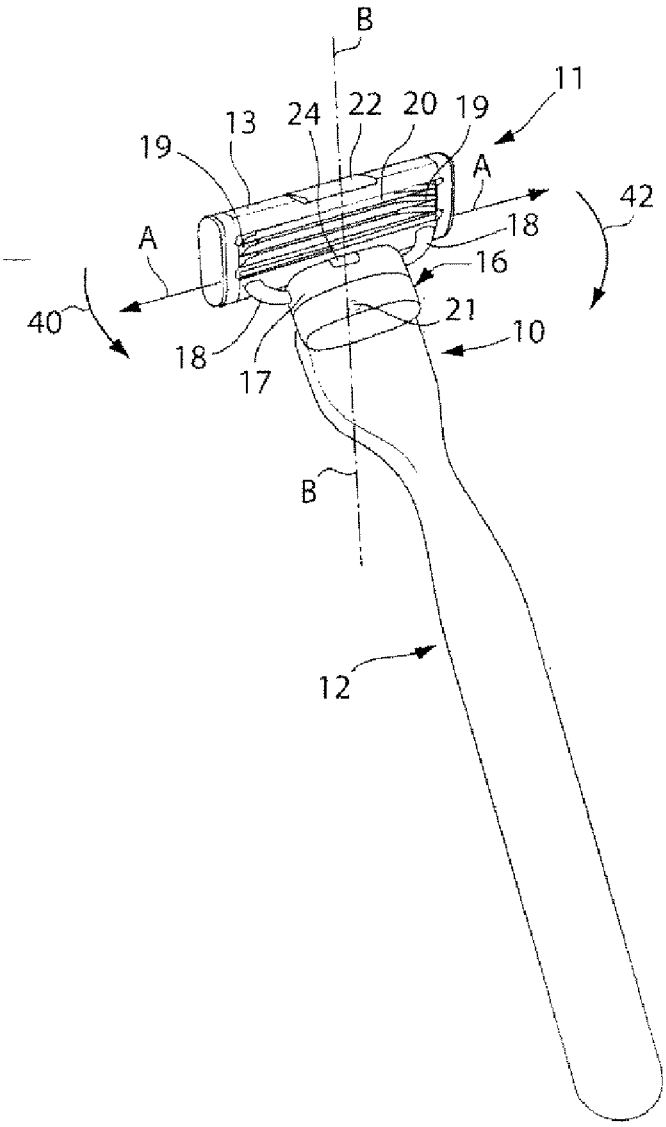
FIG. 2 is a rear perspective view of the safety razor shown in FIG. 1.
Figure 3:
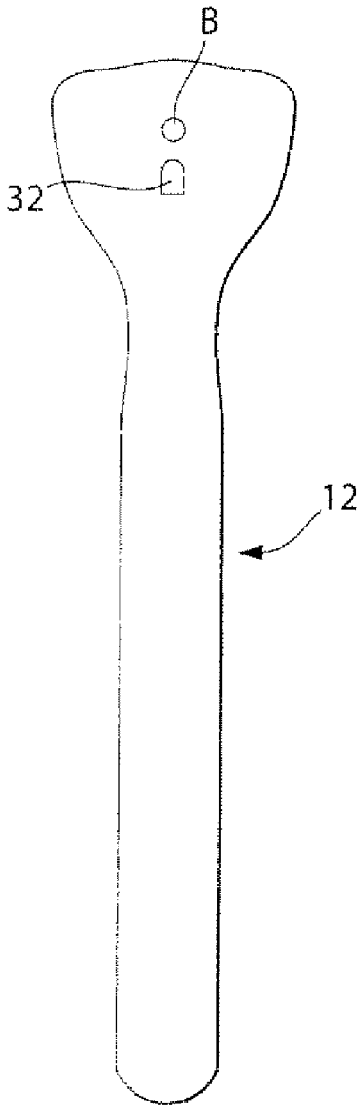
FIG. 3 is a top plan view of the handle of the safety razor shown in FIG. 1.
Figure 4:
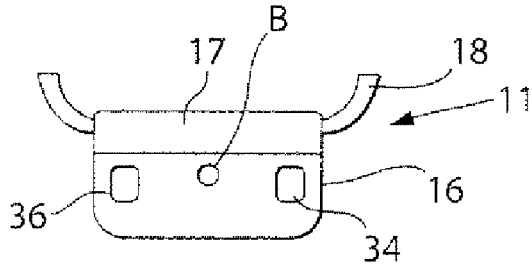
FIG. 4 is a partial cut away bottom plan view of the blade unit of the safety razor shown in FIG. 1.

The safety razor 10 illustrated in FIGS. 1-4 has a blade unit 11 mounted on a handle 12. The blade unit 11 includes a frame 13 with a guard 14 and a cap 15 and a plurality of blades 20 positioned between the guard 14 and cap 15 with their cutting edges parallel to each other, as well known in the art.

The blades 20 are movable independently of each other and are urged upwardly with respect to a plane tangential to the guard 14 and cap 15 surfaces by springs 19 which determine the force of the blades against the skin during shaving. The guard 14 preferably includes a strip of elastomeric material with projections such as fins, and the cap 15 may comprise a strip for applying a shaving enhancement product for the skin as previously known.

The blade unit 11 is provided with an attachment member 16 including a hub 17. Attachment member 16 of blade unit 11 is pivotally attached to handle 12 via pin 21. The hub 17 is detachably clipped onto attachment member 16. Hub 17 includes a pair of opposed yoke arms 18 having at their ends pivot journals which are inserted into sockets provided at the ends of the frame 13. The journals are retained in the sockets by metal clips applied around the ends of the frame 13. The journals and sockets define a first pivot axis A about which the blade unit 11 is able to pivot relative to the handle 12. The first pivot axis A is preferably in front of the blades and below a plane tangential to the guard 14 and cap 15 surfaces, although other pivot positions are possible. The first pivot axis A is substantially parallel to the plurality of blades 20. The sockets include stop faces against which the arms 18 abut when the frame 13 is in an end pivotal position, as depicted in the drawings, corresponding to a first rest position of the blade unit. Pivotal movement of the blade unit 11 away from this first rest position is opposed by a return force which is produced by a first set of opposed magnetic elements in the form of first and second small permanent magnets 22, 24. The first magnet 22 is fixed to the underside of the frame 13 adjacent the cap 15 and the second magnet 24 is fixed to the hub 17. The first magnet 22 and second magnet 24 are positioned with like poles facing each other so that when they are moved towards each other as a result of the blade unit 11 pivoting away from the first rest position as indicated by the arrow 26, a repelling force of increasing strength acting to return the blade unit 11 to the first rest position is produced between the magnets. The increasing repelling force is a non linear response acting to return the blade unit 11 to the rest position. The torque range is from about 0 to about 15 Nmm as the blade unit pivots from its rest position about first pivot axis A through the complete pivot range. Other torque ranges both larger and smaller may be used as desired. The torque can be varied by varying the spacing between magnets, the spacing of the magnets from the pivot, the strength and number of magnets used.

Preferably, the blade unit 11 has a pivot range up to about 45° about first pivot axis A. Other pivot ranges both larger and smaller may be used as desired.

The pin 21 defines a second pivot axis B about which the blade unit 11 is able to pivot relative to the handle 12. The second pivot axis B is preferably behind the frame 13 and within attachment member 16.

The second pivot axis B is substantially perpendicular to the plurality of blades 20 and to the first pivot axis A. The blade unit 11 is shown in the second rest position in FIG. 2. Pivotal movement about second pivot axis B of the blade unit 11 away from this second rest position is opposed by a return force which is produced by a second set of opposed magnetic elements.

The second set of opposed magnetic elements is in the form of third, fourth and fifth small permanent magnets 32, 34 and 36, respectively. The third magnet 32 is fixed to the topside of handle 12. The fourth magnet 34 and the fifth magnet 36 are fixed to the underside of attachment member 16. Third magnet 32 and fourth magnet 34 are positioned with like poles facing each other so that when they are moved towards each other as a result of the blade unit 11 pivoting away from the second rest position as indicated by the arrow 40 (FIG. 2), a repelling force of increasing strength acts to return the blade unit 11 to the second rest position is produced between the magnets. In the second rest position the third magnet 32 and the fourth magnet 34 are not placed on top of one another but are displaced from one another.

Third magnet 32 and fifth magnet 36 are positioned with like poles facing each other so that when they are moved towards each other as a result of the blade unit 11 pivoting away from the second rest position as indicated by the arrow 42 (FIG. 2), a repelling force of increasing strength acts to return the blade unit 11 to the second rest position is produced between the magnets. In the second rest position the third magnet 32 and the fifth magnet 36 are not placed on top of one another but are displaced from one another. The increasing repelling force is a non linear response acting to return the blade unit 11 to the rest position. The torque range is from about 0 to about 15 Nmm as the blade unit pivots from its rest position about second pivot axis B in either direction through the complete pivot range. Other torque ranges both larger and smaller may be used as desired. The torque can be varied by varying the spacing between magnets, the spacing of the magnets from the pivot, the strength and number of magnets used.

Preferably, the blade unit 11 has a pivot range up to about 30° about second pivot axis B. The range of 30° includes a pivot range of 15° in the direction indicated by arrow 40 and a pivot range of 15° in the direction indicated by arrow 42. Other pivot ranges both larger and smaller may be used as desired.

Figure 5:
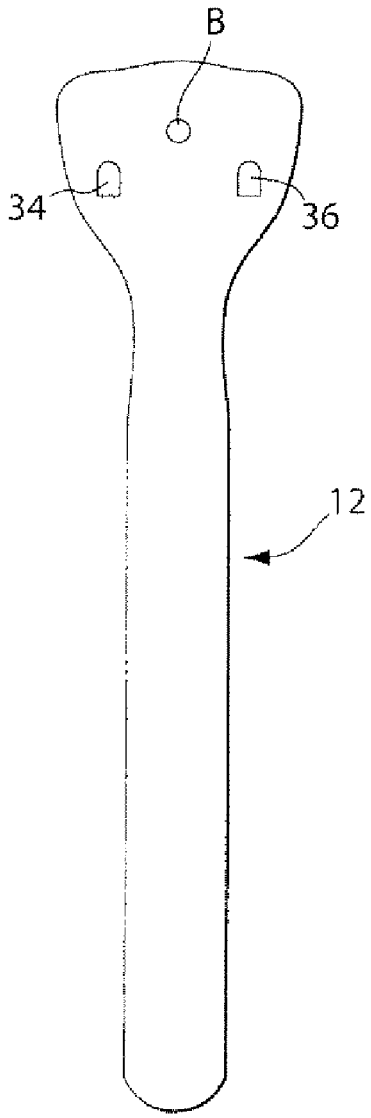
FIG. 5 is a top plan view of a handle of another safety razor of the present invention.
Figure 6:
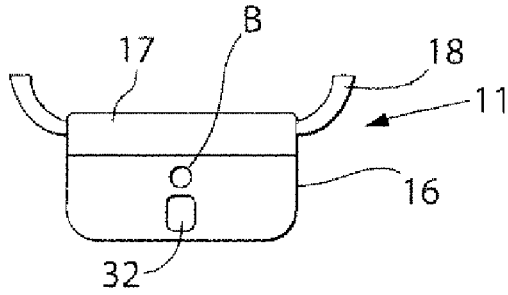
FIG. 6 is a partial cut away bottom plan view of the corresponding blade unit of the safety razor of FIG. 5.

Referring now to FIGS. 5-6, there is shown another embodiment of the safety razor of the present invention. The second set of opposed magnetic elements is in the form of third, fourth and fifth small permanent magnets 32, 34 and 36, respectively. The third magnet 32 is fixed to the underside of attachment member 16. The fourth magnet 34 and the fifth magnet 36 are fixed to the topside of handle 12. Third magnet 32 and fourth magnet 34 are positioned with like poles facing each other so that when they are moved towards each other as a result of the blade unit 11 pivoting away from the second rest position as indicated by the arrow 40 (FIG. 2), a repelling force of increasing strength acts to return the blade unit 11 to the second rest position is produced between the magnets. In the second rest position the third magnet 32 and the fourth magnet 34 are not placed on top of one another but are displaced from one another.

Third magnet 32 and fifth magnet 36 are positioned with like poles facing each other so that when they are moved towards each other as a result of the blade unit 11 pivoting away from the second rest position as indicated by the arrow 42 (FIG. 2), a repelling force of increasing strength acts to return the blade unit 11 to the second rest position is produced between the magnets. In the second rest position the third magnet 32 and the fifth magnet 36 are not placed on top of one another but are displaced from one another. The increasing repelling force is a non linear response acting to return the blade unit 11 to the rest position. The torque range is from about 0 to about 15 Nmm as the blade unit pivots from its rest position about second pivot axis B in either direction through the complete pivot range. Other torque ranges both larger and smaller may be used as desired. The torque can be varied by varying the spacing between magnets, the spacing of the magnets from the pivot, the strength and number of magnets used.

Preferably, the blade unit 11 has a pivot range up to about 30° about second pivot axis B. The range of 30° includes a pivot range of 15° in the direction indicated by arrow 40 and a pivot range of 15° in the direction indicated by arrow 42. Other pivot ranges both larger and smaller may be used as desired.

Figure 7:
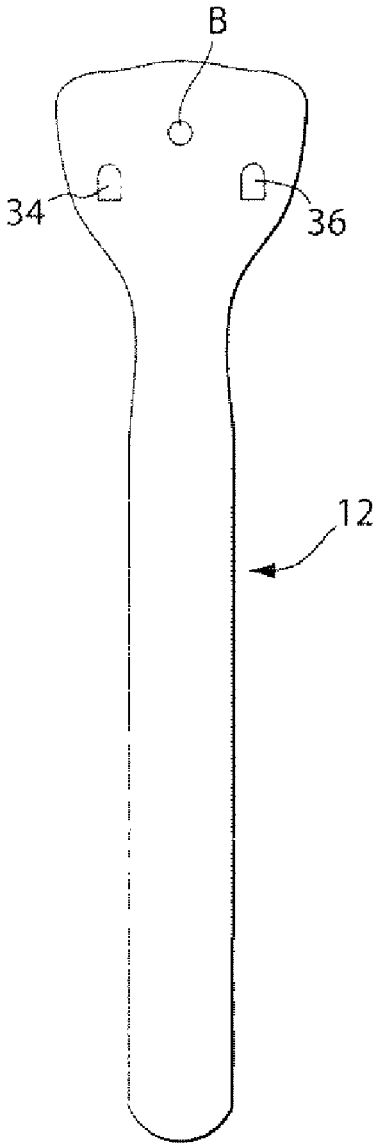
FIG. 7 is a top plan view of a handle of another safety razor of the present invention.
Figure 8:
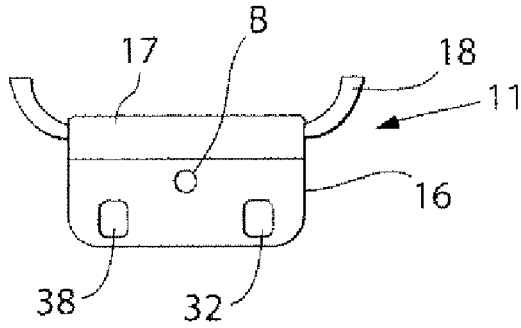
FIG. 8 is a partial cut away bottom plan view of the corresponding blade unit of the safety razor of FIG. 7.

Referring now to FIGS. 7-8, there is shown another embodiment of the safety razor of the present invention. The second set of opposed magnetic elements is in the form of third, fourth, fifth and sixth small permanent magnets 32, 34, 36 and 38, respectively. The third magnet 32 and the sixth magnet 38 are fixed to the underside of attachment member 16. The fourth magnet 34 and the fifth magnet 36 are fixed to the topside of handle 12. Third magnet 32 and fourth magnet 34 are positioned with like poles facing each other so that when they are moved towards each other as a result of the blade unit 11 pivoting away from the second rest position as indicated by the arrow 40 (FIG. 2), a repelling force of increasing strength acts to return the blade unit 11 to the second rest position is produced between the magnets. In the second rest position the third magnet 32 and the fourth magnet 34 are not placed on top of one another but are displaced from one another.

Fifth magnet 36 and sixth magnet 38 are positioned with like poles facing each other so that when they are moved towards each other as a result of the blade unit 11 pivoting away from the second rest position as indicated by the arrow 42 (FIG. 2), a repelling force of increasing strength acts to return the blade unit 11 to the second rest position is produced between the magnets. In the second rest position the fifth magnet 36 and the sixth magnet 38 are not placed on top of one another but are displaced from one another. The increasing repelling force is a non linear response acting to return the blade unit 11 to the rest position. The torque range is from about 0 to about 15 Nmm as the blade unit pivots from its rest position about second pivot axis B in either direction through the complete pivot range. Other torque ranges both larger and smaller may be used as desired. The torque can be varied by varying the spacing between magnets, the spacing of the magnets from the pivot, the strength and number of magnets used.

Preferably, the blade unit 11 has a pivot range up to about 30° about second pivot axis B. The range of 30° includes a pivot range of 15° in the direction indicated by arrow 40 and a pivot range of 15° in the direction indicated by arrow 42. Other pivot ranges both larger and smaller may be used as desired.

A further advantage of the present invention is that the strength of the return forces can easily be modified by using magnetic elements of different magnetic strength.

For razors embodying the present invention the return force characteristic increases smoothly to a maximum with the effective spring rate of the return force characteristic gradually increasing as the pivot angle increases from the respective rest position. Furthermore, during the return pivotal movement towards the first and second rest positions the return force characteristic curve closely follows that relating to the pivotal movement in the opposite direction so that the return force is always consistent for a given pivotal displacement and smooth pivotal motion is achieved, such as if the blade unit undergoes reversals of pivoting direction in the execution of a shaving stroke.

Modifications to the described embodiments are of course possible without departing from the principles of the invention. It is to be understood, therefore, that the specifically described embodiments are given by way of non limiting example only and it is intended that the invention should be limited only by the claims which follow. Whereas permanent magnets are utilized in the embodiments described above, an electromagnetic element can also be used to generate the magnetic return force and this alternative may be convenient if the razor includes a power source, such as a battery, for supplying electric current to an electrical device, such as a motor for driving a vibration generating mechanism. In addition a control device can adjust the electric current delivered to the electromagnetic element, for example in response to an output signal from a sensor for sensing pivotal movement of the blade unit from the rest position, to obtain a desired increase in magnetic return force as the pivotal displacement of the blade unit increases.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

All documents cited in the Detailed Description of the Invention are, in relevant part, incorporated herein by reference; the citation of any document is not to be construed as an admission that it is prior art with respect to the present invention. To the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A safety razor comprising a handle and a blade unit with a guard, a cap and at least one blade, the blade unit being mounted to the handle for movement relative thereto about a first pivot axis substantially parallel to the at least one blade and a second pivot axis substantially perpendicular to the at least one blade for following the skin contours during shaving, the blade unit having a first rest position relative to the first pivot axis and a second rest position relative to the second pivot axis towards which the blade unit is biased by a first return force when pivoted about said first pivot axis away from the first rest position, the first return force comprises a magnetic force generated by a first set of magnetic elements that are moved relative to each other in response to pivotal movement of the blade unit about the first pivot axis substantially parallel to the at least one blade, and the return force increases in magnitude as the blade unit pivots away from the first rest position; and a second return force when pivoted about said second pivot axis away from the second rest position, the second return force comprises a magnetic force generated by a second set of magnetic elements that are moved relative to each other in response to pivotal movement of the blade unit about the second pivot axis which is distinct from said first pivot axis, and the return force increases in magnitude as the blade unit pivots away from the second rest position.

2. The safety razor according to claim 1, wherein the second set of magnetic elements are arranged to generate a repulsive magnetic return force for urging the blade unit to the second rest position.

3. The safety razor according to claim 1, wherein the first set of magnetic elements comprises a first magnetic element and a second magnetic element and the first magnetic element is mounted to the blade unit adjacent the cap.

4. The safety razor according to claim 3, wherein the blade unit is pivotally carried by a pair of opposed arms extending from a hub, and the second magnetic element is positioned at the hub.

5. The safety razor blade unit according to claim 3, wherein the first pivot axis is positioned in front of the at least one blade.

6. The safety razor blade unit according to claim 1, wherein the first pivot axis is located below a plane tangential to the guard and cap.

7. The safety razor blade unit according to claim 1, wherein as the angle of pivoting about the first pivot axis from the first rest position increases, the spring rate characteristic of the magnetic return force increases smoothly.

8. The safety razor blade unit according to claim 1, wherein as the angle of pivoting about the second pivot axis from the second rest position increases, the spring rate characteristic of the magnetic return force increases smoothly.

9. The safety razor blade unit according to claim 1, wherein the first pivot axis is substantially perpendicular to the second pivot axis.

10. The safety razor blade unit according to claim 1, wherein at least one of the magnetic elements comprises an electromagnetic element.

11. The safety razor according to claim 1, wherein the second set of magnetic elements comprises a third magnetic element, a fourth magnetic element and a fifth magnetic element.

12. The safety razor according to claim 11, wherein the second set of magnetic elements comprises a sixth magnetic element.

13. The safety razor according to claim 11, wherein the third magnetic element is mounted to the handle and the fourth and fifth magnetic elements are mounted to the blade unit.

14. The safety razor according to claim 11, wherein the third magnetic element is mounted to the blade unit and the fourth and fifth magnetic elements are mounted to the handle.

* * * * *